3/19/85 XR 4,505,208

United States Patent [19]

Goldman

[11] Patent Number: 4,505,208

[45] Date of Patent: Mar. 19, 1985

[54] PROTECTIVE FILLING, PARTICULARLY FOR SAFE WALLS

[76] Inventor: Ilan Goldman, 10 Bar-Eli St., Tel Aviv, Israel

[21] Appl. No.: 526,495

[22] Filed: Aug. 24, 1983

Related U.S. Application Data

[63] Continuation of Ser. No. 302,757, Sep. 16, 1981, abandoned.

[30] Foreign Application Priority Data

Sep. 17, 1980 [IL] Israel ..... 61054

[51] Int. Cl.[3] ..... E04B 2/08

[52] U.S. Cl. ..... 109/85; 109/83

[58] Field of Search ..... 109/78, 79, 80, 83, 109/85

[56] References Cited

U.S. PATENT DOCUMENTS

| | | | |
|---|---|---|---|
| 1,815,187 | 7/1931 | Coles | 109/85 |
| 1,826,768 | 10/1931 | Gialdini | 109/83 |
| 1,888,042 | 11/1932 | Lynn et al. | 109/85 |
| 2,458,242 | 1/1949 | Bescherer | 109/83 |
| 3,123,025 | 3/1964 | Fugelstad | 109/83 |
| 3,302,595 | 2/1967 | Sabel | 109/85 |
| 3,732,831 | 5/1973 | Marciniak et al. | 109/83 |

*Primary Examiner*—Gene Mancene
*Assistant Examiner*—David I. Tarnoff
*Attorney, Agent, or Firm*—Ostrolenk, Faber, Gerb & Soffen

[57] ABSTRACT

A torch and drill protective filling, particularly for safe walls, consisting of a cast steel alloy grill embedded in a cast non-ferrous alloy. The safe wall filling may be formed as a discrete, separately-made element, as a part of the safe wall, or as part of the complete safe casing.

11 Claims, 4 Drawing Figures

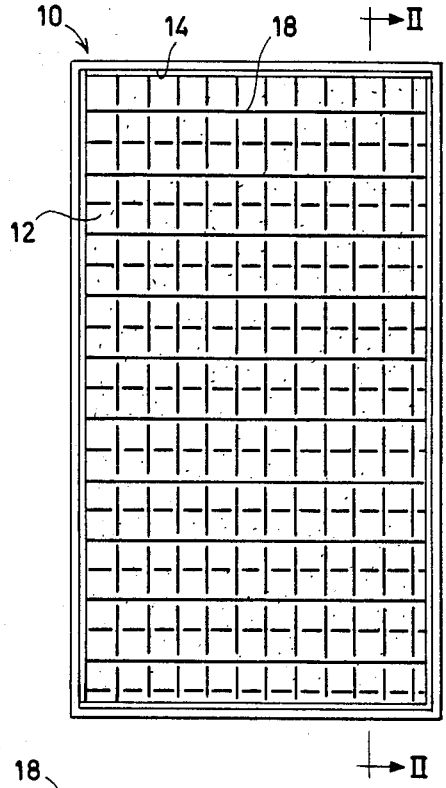
FIG. 1
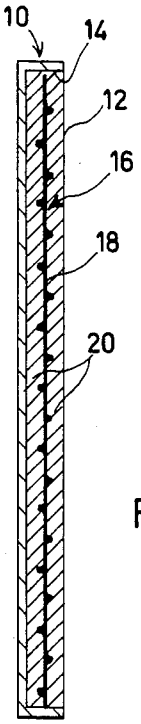
FIG. 2
FIG. 3
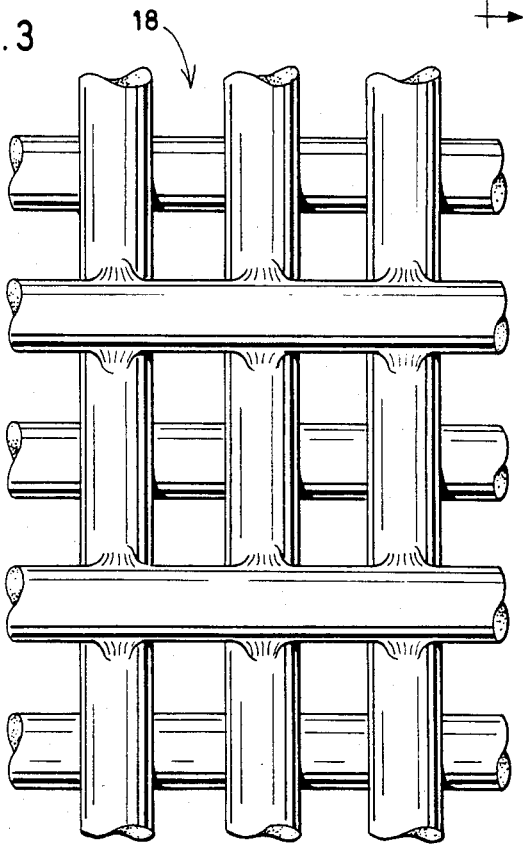
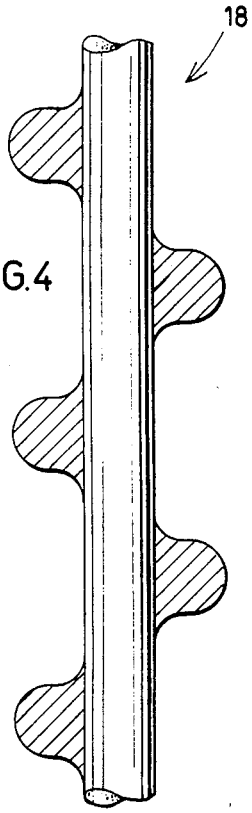
FIG. 4

PROTECTIVE FILLING, PARTICULARLY FOR SAFE WALLS

RELATED APPLICATIONS

This is a continuation of U.S. patent application Ser. No. 302,757, filed Sept. 16, 1981, now abandoned.

BACKGROUND OF THE INVENTION

The present invention relates to safe doors and walls, and more particularly to a protective filling for such doors and walls against cutting therethrough by an oxidizing flame cutting torch, on the one hand, and by mechanical cutting operations such as drilling or sawing, on the other hand (hereinafter called for short "T & D Protection").

T & D protected safe doors and walls are presently made of a series of steel plates interposed between a series of ferrous or non-ferrous metal plates; the latter plates, which are known to possess high heat conductivity rates provide the necessary resistance against flame cutting, whereas the former, against drilling, hammering, sawing and the like mechanical cutting methods.

Such modular or hybride structure doors and walls are costly in production and difficult in the handling and assembling thereof.

Over sixty years ago, it was for the first time proposed to achieve T & D protection of vault doors by forming the doors with a core of a drill-proof material and casting therearound a sheath of heat-conductive metal. (Guardian Metals Co. U.S. Pat. Nos. 1,755,913 and 1,815,187).

According to the last mentioned patent, there have been prepared safe and vault members comprising a cast-metal matrix of high heat conductivity in which there were embedded a plurality of slabs of metallic material in substantial parallelism, such slabs being tool-resistant and being made up of a composition consisting of 13–20% manganese, 13–18% chromium, 2–4% carbon and the balance iron.

As exemplified in the specification, the composite slab assemblies were made up of slats so arranged as to provide overlapping between the several slats, thus preventing the formation of any direct apertures from one side to the other. These members were set in position in a suitable mold, spaced apart a suitable distance, and a sheath of heat resistant metal was cast therearound.

The slat members were cast up in the usual manner, and were provided with inserts in the form of a mesh of malleable iron rods or wire for reinforcing the cast slats, particularly where large dimension slats were used.

This T & D protection method never gained commercial success, due to the following main reasons. Since the outer casting or sheathing was inherently soft and weak, it was quite easily possible to drill or otherwise cut through the cast material (e.g. with a compass-saw) precisely around an embedded slab, thus attaining access thereto. The entire slab could then be pulled out, and the procedure be repeated with respect to the following, deeper embedded slab, until an opening in the door was formed.

Furthermore, rather than attempting to withdraw a complete slab, it had frequently happened that, again, a portion of the soft sheath was mechanically removed, and the opening continued through the cast iron or steel slab by a torch, and so forth. In fact, after reaching and melting part of the first slab, the proceeding process of flame-cutting—even through the supposedly torch-proof material—became less difficult because the molten metal of the slab actually catalyzed the fusion of the surrounding metal.

It will also be noted that the inner spaced occupied by the relatively large slabs, seriously affected the heat conductivity properties of the wall as a whole.

BRIEF DESCRIPTION OF THE INVENTION

The present invention utilizes the basic concept of providing a combination of T & D protection materials, however, in an improved, advantageous manner.

According to one aspect of the invention, there is provided a torch and drill protective filling, particularly for safewalls and doors, said filling consisting of a cast steel alloy grill embedded in cast non-ferrous alloy.

According to other aspects of the present invention, there are provided various methods of applying the protective fillings to safes, namely, as discrete, separately-made elements, as a part of a safe wall, or as part of a complete safe casing.

By providing a steel alloy grill—rather than discrete, cast iron large dimensioned slabs—a two-fold advantage is achieved: The grill does not occupy a large amount of the overall space of the door which would cause a loss in the heat conductivity of the surrounding non-ferrous metal casting; and the grill becomes integrally formed with the casting so that locally exposing a portion of the grill will not enable the extraction or pulling out of the remaining portions thereof.

BRIEF DESCRIPTION OF THE DRAWINGS

The invention will now be described, by way of a non-limiting example only, with reference to the accompanying drawings wherein:

FIG. 1 is a general schematic view of a wall armoured by a filling made according to the principles of the present invention;

FIG. 2 is a cross-sectional view taken along lines II—II of FIG. 1;

FIG. 3 shows a cast metal grid or grill suitable for the purpose of the present invention; and FIG. 4 is a side view of the grill of FIG. 3.

DETAILED DESCRIPTION OF THE INVENTION

In FIG. 1, 10 denotes a safe door or wall viewed from the inside to show a protective filling 12 in the form of a separately made (or cast in-situ—see below) slab, which fills a recess 14 of the wall. Slab 12 is comprised of a central core 16 constituted by a grill 18, embedded within a cast non-ferrous alloy marked 20.

In practice, the grill 18 is separately produced, then put in a mold, or directly into the recess 14, alternatively, all three side walls, bottom and top walls of a complete safe casing (not shown) may be processed in one shot, i.e. put into a somewhat larger box-like mold, (not shown) with the grill suitably positioned in the gaps enveloping the outside of the casing; molten non-ferrous alloy would be poured over the grill, thus forming the all-around complete filling slab(s) 12.

A special cast steel alloy grill is used, rather than standard, commercially available tempered steel-wire or the like grids, because drawn or rolled hardened steel will necessarily become "annealed" or softened during the cooling of the molten alloy in which the grid is submerged. Obviously, the melting point of the steel alloy is necessarily above the melting point of the cast non-ferrous alloy.

FIGS. 3 and 4 show an example of such cast steel alloy wire grid or grill but of course any other pattern of grid may be used.

The non-ferrous alloy casting 20 may be aluminum alloy of a heat conductivity above 150 W/m° C., or copper alloy of over 350 W/m° C.

The grill 18 may be made of cast steel alloy containing Cr, Ni, Co, Mo, V, Ti, W, Mm, or Si, and having a hardness of 45–65 HRC.

Although the non-ferrous alloy inherently presents low resistance against mechanical cutting such as drilling, the protection against burglary by drilling would be provided by the grill 18; on the other hand, the drill-proof grill 18 which extends throughout the complete wall area, although quite easily cut by a cutting torch, will be protected thereagainst by being embedded between and enveloped by a solid block of high heat conducting metal. The combined structure will therefore provide the required extreme resistance against either of the two burglary techniques.

It will be noted by those skilled in the art that the method of providing the protective filling—either in the form of separately molded slabs or in the in-situ casting manner (including casting at one time of all five walls of a safe as above mentioned)—is superior in many respects over the conventional multi-slab structures: The grill could not be pulled out after partly exposing it by mechanical means; and a minimum heat-conducting loss of the enveloping non-ferrous alloy is assured.

As this invention may be embedded in several forms without departing from the spirit or essential characteristics thereof, the present embodiment is therefore illustrative and not restrictive, and since the scope of the invention is defined by the appended claims, all changes that fall within the metes and bounds of the claims or that form their functional as well as conjointly cooperative equivalent are therefore intended to be embraced by those claims.

What is claimed is:

1. A torch and drill protective safe wall, comprising:

a heat conducting non-ferrous alloy forming the main structural component of said wall;

a cast steel alloy grill directly embedded in said heat conducting non-ferrous alloy and extending to the edges of said wall, said cast grill being of a type which will not become annealed when said grill is located in a cooling molten alloy used to form said main structural component of said wall.

2. The safe wall of claim 1, wherein said safe wall is formed by molding said non-ferrous alloy around said cast steel alloy grill such that said non-ferrous alloy and said cast steel alloy become integral with one another.

3. The safe wall of claim 1, wherein the heat conductivity of said non-ferrous alloy is above 150 W/m° C.

4. The safe wall of claim 1, wherein the hardness of said steel alloy is above 45 HRC.

5. A torch and drill protective safe wall, comprising:

a frame having a recess formed therein;

a heat conducting non-ferrous alloy filling said recess and forming the main structural component of said wall;

a cast steel alloy grill directly embedded in said heat conducting non-ferrous alloy and extending to the inner peripheral edges of said recess, said cast grill being of a type that will not become annealed when said grill is located in a cooling molten alloy used to form said main structural component of said wall.

6. The safe wall of claim 5, wherein said non-ferrous alloy is cast around said steel alloy grill such that said non-ferrous alloy and said steel alloy grill become integral with one another.

7. The safe wall of claim 5, wherein the heat conductivity of said non-ferrous alloy is above 150 W/m° C.

8. The safe wall of claim 5, wherein the hardness of said steel alloy is above 45 HRC.

9. A method for forming a torch and drill protective safe wall, comprising the steps of:

casting a steel alloy grill;

placing said steel alloy grill in a mold having a recess whose inner dimensions define the outer dimensons of a torch and drill protective insert, said steel alloy grill extending to the inner peripheral edges of said recess;

castng a non-ferrous alloy in said mold such that said non-ferrous alloy forms the main structural component of said insert and such that said steel alloy grill and said non-ferrous alloy become integral with one another, said steel alloy grill being of a type which will not be annealed when said non-ferrous alloy is cooled in said recess; and removing said inset from said mold and placing it in a recess of a safe wall.

10. A method for forming a torch and drill protective safe wall, comprising the steps of:

placing a cast steel alloy grill in a recess formed in a safe wall, said steel alloy grill extending to the inner peripheral edges of said recess; and casting a non-ferrous alloy in said recess such that said non-ferrous alloy forms the main structural component of said wall and such that said steel alloy grill and said non-ferrous alloy becom integral with one another, said steel alloy grill being of a type which will not be annealed when said non-ferrous alloy is cooled in said recess.

11. A method for forming a shell for a torch and drill protective safe wall, comprising the steps of:

placing a five-sided inner casing in a five-sided mold of longer dimensions than said inner casing such that said five walls of said inner casing are spaced from respective inner walls of said mold;

placing cast steel alloy grills between said inner casing walls and said inner walls of said mold such that said steel alloy grills extend to the edges of each inner casing wall; and casting a non-ferrous alloy into said spaces between said inner casing walls and said inner walls of said mold such that said non-ferrous alloy forms the main structural component of said shell and such that said steel alloy grills become integral with said non-ferrous alloy, said steel alloy grills being of a type which will not be annealed when said non-ferrous alloy is cooled in said mold.

* * * * *